US008413458B2

(12) United States Patent
Spratley

(10) Patent No.: US 8,413,458 B2
(45) Date of Patent: Apr. 9, 2013

(54) DEVICE FOR RETAINING BEVERAGE COOLING MEANS WITHIN A VESSEL

(76) Inventor: David Derek Grant Spratley, Surrey (GB)

( * ) Notice: Subject to any disclaimer, the term of this patent is extended or adjusted under 35 U.S.C. 154(b) by 0 days.

(21) Appl. No.: 12/742,836

(22) PCT Filed: Nov. 17, 2008

(86) PCT No.: PCT/GB2008/051073

§ 371 (c)(1),
(2), (4) Date: May 13, 2010

(87) PCT Pub. No.: WO2009/063251

PCT Pub. Date: May 22, 2009

(65) Prior Publication Data

US 2011/0113818 A1 May 19, 2011

(30) Foreign Application Priority Data

Nov. 16, 2007 (GB) ..... 0722501.4

(51) Int. Cl.
*F25D 3/00* (2006.01)

(52) U.S. Cl.
USPC ..... 62/293; 62/510

(58) Field of Classification Search ..... 62/293, 62/457.2, 457.3, 457.4, 530, 371, 372, 459; 220/592.16, 592.17
See application file for complete search history.

(56) References Cited

U.S. PATENT DOCUMENTS

| | | | | | |
|---|---|---|---|---|---|
| 1,471,449 | A | * | 10/1923 | Cahill | 62/457.1 |
| 2,016,514 | A | | 10/1935 | Putnam | |
| 2,144,177 | A | * | 1/1939 | Blomquist | 62/457.1 |
| 2,805,554 | A | * | 9/1957 | Schachtsiek | 62/7 |
| 3,146,600 | A | * | 9/1964 | Cox | 62/3.62 |
| 4,325,230 | A | | 4/1982 | Driscoll et al. | |
| 4,761,314 | A | * | 8/1988 | Marshall | 428/11 |
| 4,843,836 | A | * | 7/1989 | Childers | 62/293 |
| 5,058,396 | A | * | 10/1991 | Faiola | 62/457.2 |
| 5,235,823 | A | * | 8/1993 | Coker | 62/530 |
| 5,357,761 | A | * | 10/1994 | Schauer | 62/56 |
| 5,568,973 | A | * | 10/1996 | Gorab | 366/129 |
| 5,701,747 | A | * | 12/1997 | Faiola et al. | 62/68 |
| 5,799,501 | A | * | 9/1998 | Leonard et al. | 62/457.3 |
| 5,971,202 | A | | 10/1999 | Filbrun | |
| 6,035,659 | A | * | 3/2000 | Fernandez | 62/457.4 |
| 6,338,570 | B1 | * | 1/2002 | Santacruz-Olivares | 366/144 |
| 7,028,505 | B2 | * | 4/2006 | Cardinale | 62/372 |
| 7,272,950 | B1 | * | 9/2007 | Roman | 62/384 |
| 2005/0210911 | A1 | | 9/2005 | Dyrbye | |

FOREIGN PATENT DOCUMENTS

| | | | |
|---|---|---|---|
| DE | 3034017 | A1 | 4/1982 |
| GB | 2428464 | A | 1/2007 |

* cited by examiner

*Primary Examiner* — Mohammad Ali
(74) *Attorney, Agent, or Firm* — Gordon & Jacobson, PC

(57) ABSTRACT

A device (10) for retaining beverage cooling means (11) within a vessel (12) is disclosed. The device comprises a vessel engaging portion (14) and means (16) for engaging the beverage cooling means (11), wherein the means (16) for engaging the beverage cooling means (11) permits the beverage cooling means to move in sliding relation with respect to the vessel (14) engaging portion.

15 Claims, 3 Drawing Sheets

DEVICE FOR RETAINING BEVERAGE COOLING MEANS WITHIN A VESSEL

BACKGROUND OF THE INVENTION

1. Field of the Invention

The present invention relates to a device for retaining beverage cooling means within a vessel.

2. State of the Art

It is well known to cool beverages by adding one or more ice cubes to the beverage. However, a disadvantage of this arrangement is that the water from which the ice is made can contain micro-organisms, which can be harmful if ingested with the beverage as the ice melts.

Another disadvantage of ice cubes is that, as the ice melts, the water dilutes the beverage and detracts from its overall strength and taste of the beverage.

U.S. Pat. No. 4,325,230 attempts to overcome the above-mentioned problems by providing a device comprising a sealable cubic housing, into which an ice cube can be placed. In use, one or more of such devices can be frozen and then added to drinks. The ice is contained inside the housing and thus does not contaminate or dilute the beverage as it melts. Following use, the device can be washed and reused. In an alternative embodiment, the body of water is permanently sealed inside the housing and the device itself is frozen prior to use.

A disadvantage of ice and the above-mentioned device is that they are relatively easy to swallow, particularly as they float on the surface of the beverage. GB2428464 overcomes this problem by providing an arm which engages with the vessel and which is secured to the cooling means, to enable the cooling means to be positioned near to the bottom of the vessel. However, as the beverage is consumed it becomes necessary to reposition the cooling means lower in the vessel so that it remains immersed within the beverage.

Moreover, the use of the arm is limited to vessels having a particular height, since too small a vessel means that the arm must be wrapped around the interior of the vessel to position the cooling means within the beverage; this can affect the ability of a person to drink from the vessel. Conversely, with taller vessels the arm is often too short to enable the cooling means to reach the bottom of the vessel to cool the beverage.

SUMMARY OF THE INVENTION

I have now devised a device for retaining beverage cooling means within a vessel, which alleviates the above-mentioned problems.

In accordance with the present invention as seen from a first aspect there is provided a device for retaining beverage cooling means within a vessel, the device comprising a vessel engaging portion and means for engaging the beverage cooling means, wherein the means for engaging the beverage cooling means permits the beverage cooling means to move in sliding relation with respect to the vessel engaging portion.

The ability of the beverage cooling means to slide with respect to the vessel engaging portion enables the beverage cooling means to be positioned at the bottom of vessels having a range of heights. The vessel engaging portion preferably comprises an arm, the proximal end of which is secured to a clip that is arranged to engage the rim of the vessel.

Preferably, the means for engaging the beverage cooling means is disposed at the distal end of the arm and comprises a yoke, which may be made an integral part of the arm. The yoke preferably comprise a projection which extend substantially inwardly of the yoke from each end thereof.

The beverage cooling means preferably comprises a pair of grooves extending along opposite sides thereof, within which the projections extend. In this manner, the device of the present invention can be secured to the rim of vessels having different heights, since the beverage cooling means can move in sliding relation to the yoke to move up and down within the vessel. The beverage cooling means can slide upon the projections to provide a range of working lengths of the device and therefore accommodate vessels having different heights.

The yoke may be arranged such that the projections can snap fit within the grooves formed within the beverage cooling means.

Preferably, the beverage cooling means comprise a housing for holding liquid or gel, the liquid or gel being arranged to absorb heat from the beverage, so as to provide a cooling effect on the beverage.

The housing is preferably sealed; the user having to freeze the liquid or gel within the housing prior to use. Alternatively, the housing can preferably be opened to allow an ice cube to be inserted into a compartment within the housing.

In a further alternative, the beverage cooling means is an ice cube comprising a groove formed on opposite sides thereof to receive the projections of the yoke.

In accordance with the present invention as seen from a second aspect, there is provided a beverage cooling device, the device comprising a body portion arranged for immersion in the beverage and a vessel engaging portion which engages a vessel in which the beverage is provided, the vessel engaging portion further comprising means for engaging the body portion, such that the body portion can move in sliding relation with respect to the vessel engaging portion.

Preferably, the body portion is arranged to absorb heat from the beverage to cool the beverage.

The preferred embodiment of the present invention will now be described by way of example only and with reference to the accompanying drawings.

BRIEF DESCRIPTION OF THE PREFERRED EMBODIMENTS

Figure 1:
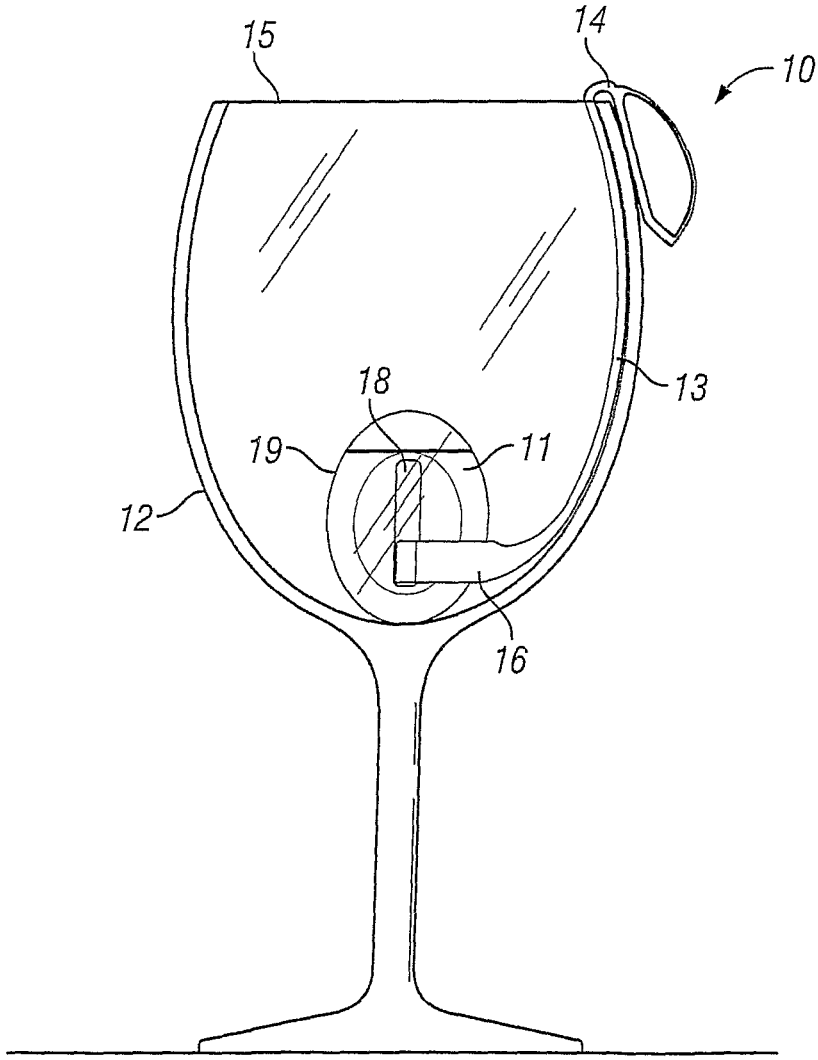
FIG. 1 is a side view of the device of the present invention secured within a wine glass.
Figure 2:
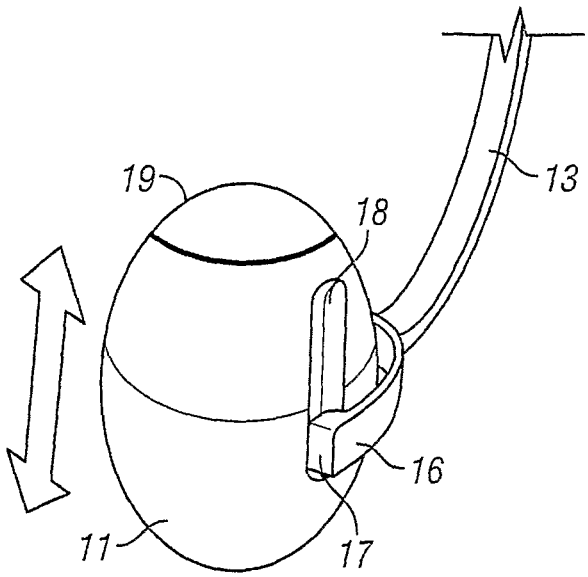
FIG. 2 is a magnified perspective view of the yoke of FIG. 1 in a first position on the beverage cooling means.
Figure 3:
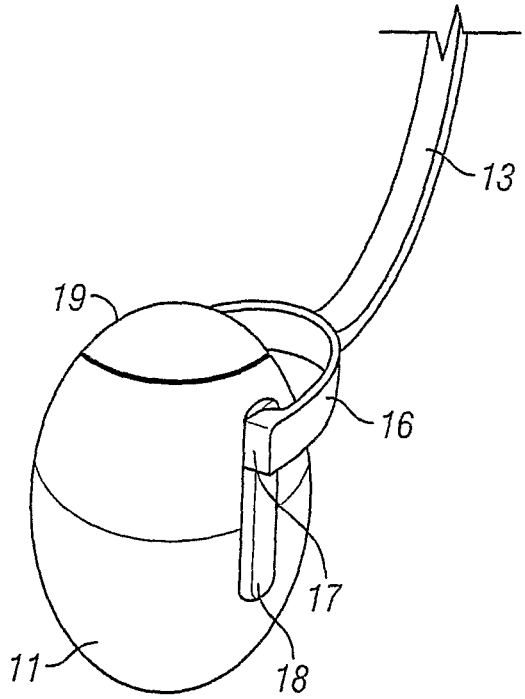
FIG. 3 is a magnified perspective view of the yoke of FIG. 1 in a second position on the beverage cooling means.

Referring to FIGS. 1 to 3, there is provided a device 10 for retaining beverage cooling means 11 within a vessel 12, for example a wine glass. The device 10 may be formed substantially of a plastic material and comprises an arm 13, which extends into the vessel 12 and engages with beverage cooling means 11, which acts to cool a beverage (not shown) provided within the vessel 12. The arm 13 may be curved (as shown in FIGS. 1 to 3) to follow the interior contour of a wine glass for example, or substantially straight to extend directly toward the base of the vessel 12 (as shown in FIG. 4).

The outermost section of the arm 13 is folded back on itself to define a hooked clip 14, which engages with the rim 15 of the vessel 12. Teeth or elastomeric gripping members (not shown) are preferably provided on the opposed faces of the hooked clip 14, in order to securely grip the rim 15 of the vessel 12.

The end of the arm 13 which extends into the vessel 12 is secured to a yoke 16; alternatively, the yoke 16 may be made an integral part of the arm 13. The yoke 16 comprises a pair of projections 17. Each projection 17 of the pair extends radially inwardly of the yoke 16, from each end of the yoke 16 and is dimensioned to fit within a groove 18 formed on opposite sides of the beverage cooling means 11. The grooves 18 extend substantially parallel to each other on opposite sides of the beverage cooling means 11 and are orientated so that the beverage cooling means 11 can move up and down within the vessel 12, by sliding on the projections. The ends of the projections 17 however, which engage with the grooves 18 are substantially flat and squared off at the sides to minimise any rotation of the beverage cooling means 11 with respect to the yoke 16.

Figure 4:
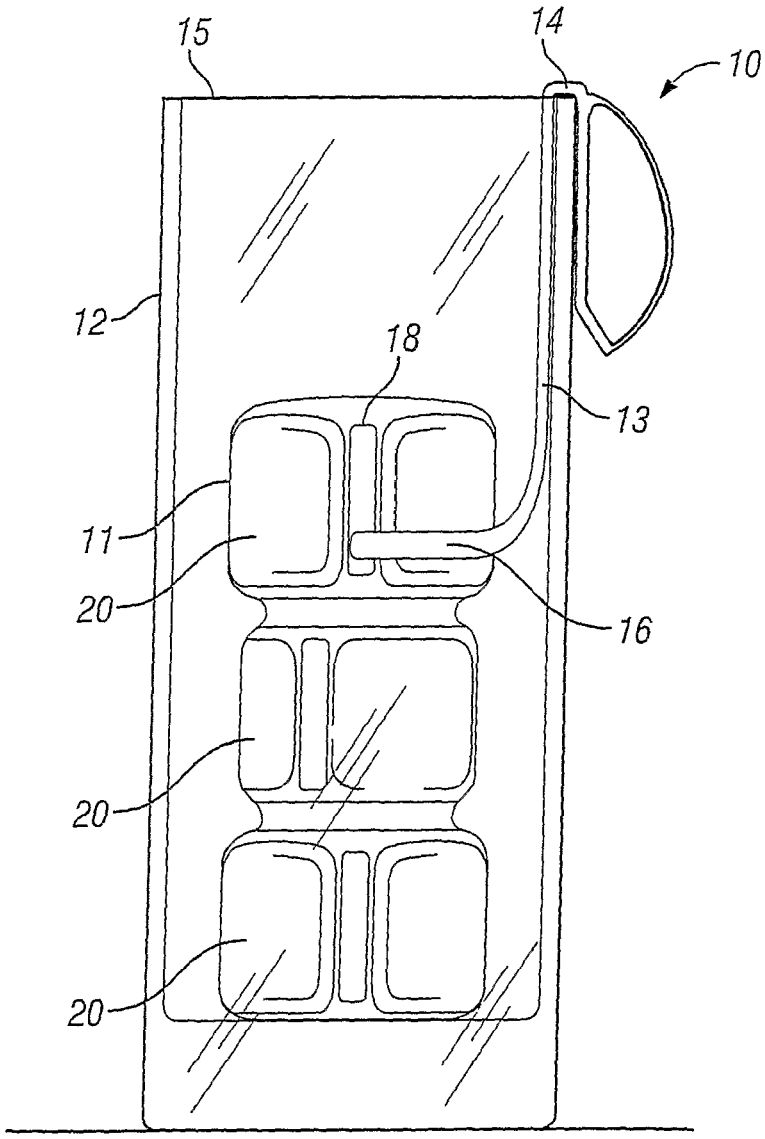
FIG. 4 is a side view of the device of the present invention secured within a half-pint glass.

The beverage cooling means 11 may comprise a housing 19 filled with a liquid or gel which absorbs heat from the beverage to cool the beverage, or more simply an ice cube 20, as shown in FIG. 4.

In use the yoke 16 is positioned around an ice cube 20, for example, so that the projections extend within the grooves 18 formed therein, and the clip 14 is secured to the rim 15 of the vessel 12, so that the arm 13 and thus beverage cooling means 11 extend into the vessel 12. As the clip 14 is pushed down onto the rim 15 of the vessel 12, the ice cube 20 will engage the base of the vessel 12, but the arm 13 and thus yoke 16 may be further pushed down into the vessel 12 as the projections 17 slide down the ice cube 20, within the grooves 18. In this manner, the length of the grooves 18 provides a range to the height of vessel heights within which the device 10 can be used to position the ice cube 20, or other cooling means 11, at the bottom of the vessel 12.

With very tall vessels, several ice cubes 20 may be placed within the vessel 12 and held toward the base of the vessel 12, as shown in FIG. 4, by positioning the ice cube 20 that is secured to the yoke 16, above them.

The ice cube(s) 20 absorbs heat from the beverage contained in the vessel 12, so as to cool the beverage. If desired, a plurality of devices 10 may be attached to the vessel 12.

A device in accordance with this invention is simple and inexpensive in construction, yet provides a safe and reliable way of retaining ice and other beverage cooling bodies within a beverage held within a vessel.

What is claimed is:

1. A device for retaining a beverage cooling means within a vessel, the device comprising:

a vessel engaging portion configured to engage the vessel; and a means for engaging the beverage cooling means, the means for engaging the beverage cooling means being adapted to allow the beverage cooling means to move relative to the vessel engaging portion;

wherein the means for engaging the beverage cooling means comprises a yoke, the yoke including a projection extending substantially inwardly from each end of the yoke; and wherein the beverage cooling means defines a pair of grooves extending along opposite sides thereof, said projection extending from each end of the yoke extending into a respective one of said pair of grooves, such that the beverage cooling means can move in sliding relation to the yoke to move up and down within the vessel.

2. The device of claim 1, wherein:

the vessel engaging portion comprises an arm and a clip, said arm has a proximal end secured to said clip, and said clip is arranged to engage a rim of the vessel.

3. The device of according to claim 1, wherein:

said arm has a distal end, and the means for engaging the beverage cooling means is disposed at the distal end of the arm.

4. The device of claim 1, wherein:

the beverage cooling means includes a housing for holding liquid or gel capable of absorbing heat from the beverage to cool the beverage.

5. The device of claim 4, wherein:

the liquid or gel is sealed within the housing.

6. The device of claim 4, wherein:

the housing can be opened to allow an ice cube to be inserted into a compartment within the housing.

7. The device of claim 1, wherein:

said means for engaging the beverage cooling means is slidably coupled to said beverage cooling means.

8. The device of claim 1, wherein:

said beverage cooling means is upwardly and downwardly slidable relative to said vessel engaging portion while engaged with said means for engaging.

9. A beverage cooling device, comprising:

a beverage cooling means arranged for immersion in a beverage; and a vessel engaging portion capable of engaging a vessel in which the beverage is provided, the vessel engaging portion having means for slidably engaging the beverage cooling means;

wherein the means for slidably engaging the beverage cooling means comprises a yoke, the yoke including a projection extending substantially inwardly from each end of the yoke; and wherein the beverage cooling means defines a pair of grooves extending along opposite sides thereof, said projection extending from each end of the yoke extending into a respective one of said pair of grooves, such that the beverage cooling means can move in sliding relation to the yoke to move up and down within the vessel.

10. The beverage cooling device of claim 9, wherein:

the beverage cooling means is adapted to absorb heat from the beverage to cool the beverage.

11. A beverage cooling device for cooling a beverage provided in a vessel, the device comprising:

a beverage cooling means capable of being immersed in the beverage for cooling the beverage; and a member having a vessel engaging portion configured to engage the vessel and a means for slidably engaging the beverage cooling means;

wherein the means for slidably engaging the beverage cooling means comprises a yoke, the yoke including a projection extending substantially inwardly from each end of the yoke; and wherein the beverage cooling means defines a pair of grooves extending along opposite sides thereof, said projection extending from each end of the yoke extending into a respective one of said pair of grooves, such that the beverage cooling means can move in sliding relation to the yoke to move up and down within the vessel.

12. The beverage cooling device of claim 11, wherein:

said beverage cooling means is upwardly and downwardly slidable relative to said means for slidably engaging while engaged therewith.

13. The beverage cooling device of claim 11, wherein:

said beverage cooling means includes a housing for holding at least one of a liquid, a gel, and a solid.

14. The beverage cooling device of claim 11, wherein:

said beverage cooling means and said member are separate and distinct.

15. The beverage cooling device of according to claim 11, wherein:

the vessel has a rim, said vessel engaging portion has an arm and a proximally situated clip, said clip is configured to grasp the rim of the vessel, and said arm extends between said clip and said means for slidably engaging said beverage cooling means.

* * * * *